United States Patent [19]

Pereyra

[11] Patent Number: 4,749,084

[45] Date of Patent: Jun. 7, 1988

[54] TAMPER-INDICATING PACKAGE WITH RANDOMLY DISPOSED FILAMENTS

[75] Inventor: Rodger J. Pereyra, Cottage Grove, Minn.

[73] Assignee: Minnesota Mining and Manufacturing Co., St. Paul, Minn.

[21] Appl. No.: 930,321

[22] Filed: Nov. 12, 1986

[51] Int. Cl.[4] ..... B65D 27/30

[52] U.S. Cl. ..... 206/459; 206/484; 206/807; 283/72; 283/109; 383/5; 428/916

[58] Field of Search ..... 206/459, 807, 461, 484; 383/5; 283/77, 94, 107, 111, 75, 109, 110, 72; 428/916; 40/2.2

[56] References Cited

U.S. PATENT DOCUMENTS

| | | | |
|---|---|---|---|
| 2,588,067 | 3/1952 | Whitehead | 283/77 X |
| 2,835,993 | 5/1958 | Whitehead | 283/111 X |
| 3,413,171 | 11/1968 | Hannon | 283/110 X |
| 3,450,256 | 6/1969 | Chandler et al. | 206/461 |
| 3,575,782 | 4/1971 | Hansen | 161/141 |
| 3,662,156 | 5/1972 | Grosbard | 283/72 X |
| 4,324,421 | 4/1982 | Moran et al. | 283/75 |
| 4,389,472 | 6/1983 | Neuhaus et al. | 430/10 |
| 4,429,015 | 1/1984 | Sheptak | 428/916 X |
| 4,456,667 | 6/1984 | Bochow et al. | 430/10 |
| 4,469,353 | 9/1984 | Anarwala | 283/74 |
| 4,506,914 | 3/1985 | Gobeli | 283/70 |
| 4,509,196 | 4/1985 | Sak et al. | 383/5 |

*Primary Examiner*—Stephen Marcus
*Assistant Examiner*—Bryon Gehman
*Attorney, Agent, or Firm*—Donald M. Sell; James A. Smith; David L. Weinstein

[57] ABSTRACT

Tamper-indicating package comprising two webs, each of which comprises a layer of polymeric material and a layer of continous filaments disposed in a random arrangement. The filaments are bonded to said polymeric layer. Upon access to the interior of the package, either the random arrangement of filaments will be altered or the polymeric layer will be damaged, thus indicating that the package has been subject to tampering.

13 Claims, 2 Drawing Sheets

TAMPER-INDICATING PACKAGE WITH RANDOMLY DISPOSED FILAMENTS

BACKGROUND OF THE INVENTION

This invention relates to packages, and, more particularly, to packages having a means for detecting unauthorized tampering therewith.

It is frequently desired by corporations or government agencies to transmit confidential or secret documents from one location to another. From the time the documents leave the sender to the time they are received by the recipient, the documents are subject to being temporarily removed from their container, duplicated, and replaced in their container by unauthorized third parties in such a way that the sender and receiver have no knowledge that the confidentiality or secrecy of the documents has been compromised. The ramifications of this breach of confidentiality are well-known.

Accordingly, it would be desirable to provide an inexpensive, easy-to-use, tamper-indicating package for the transmission of confidential or secret documents.

SUMMARY OF THE INVENTION

This invention involves a tamper-indicating package comprising two webs, each of which comprises (1) a layer of polymeric material, and (2) a layer of continuous filaments disposed in a random arrangement, said layer of filaments bonded to said polymeric layer so that either said random arrangement will be altered upon access to the interior of said package or said polymeric layer will be damaged. A document or other article can be placed between the polymeric layers of the webs, and the margin of the polymeric layers sealed to form the package. The webs of the resulting package are then imaged to provide pictures of the randomly disposed filaments. Comparison of the pictures of the webs with the delivered package will indicate whether a party other than the sender or receiver has gained access to the contents of the package.

DETAILED DESCRIPTION

Figure 1:
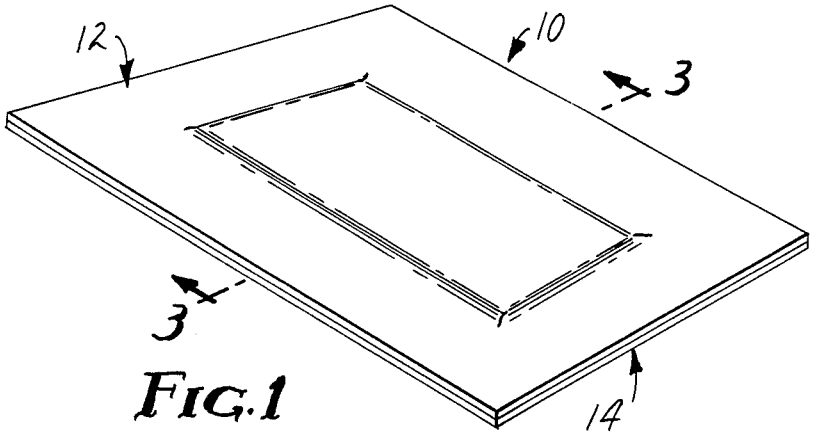
FIG. 1 is a perspective view of the preferred embodiment of the sealed package of this invention.
Figure 2:
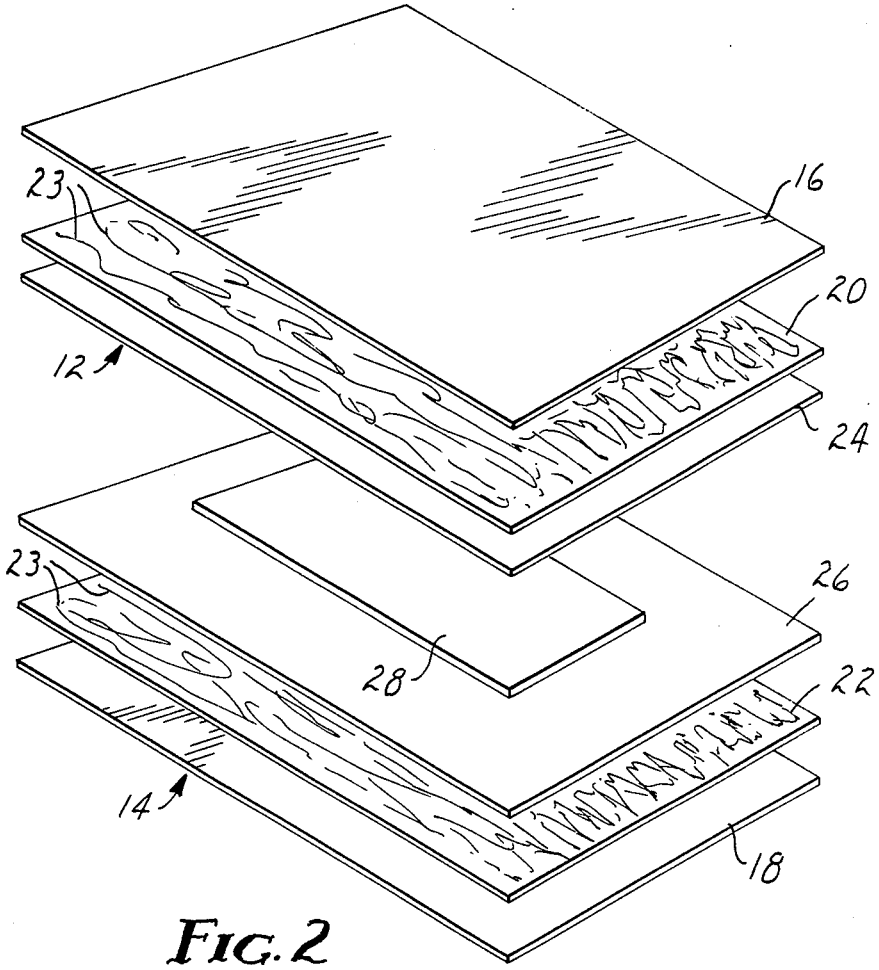
FIG. 2 is an exploded perspective view of the preferred embodiment of the package of this invention.
Figure 3:
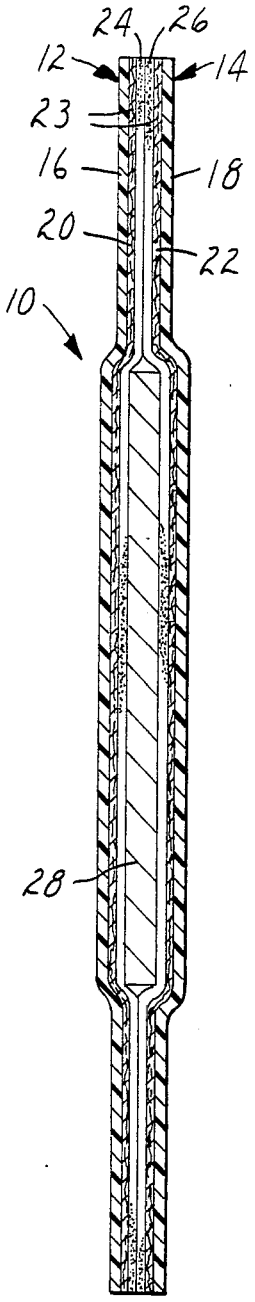
FIG. 3 is a sectional view taken along line 3—3 of FIG. 1.

With reference to FIGS. 1, 2, and 3, the package 10 of this invention is formed from first and second coextensive webs 12 and 14. Although webs 12 and 14 are shown as two distinct coextensive webs, it is within the scope of this invention that webs 12 and 14 be formed of a single web having two symmetrical halves, whereby the package can be formed by folding one-half of the web over the other half of the web and then sealing the one half to the other half. The webs are preferably rectangular in shape. However, other shapes, e.g. circular, polygonal, can be used.

Each web of the preferred embodiment comprises an outer layer 16 and 18 made of a polymeric, e.g. thermoformable, material. The material of the outer layer serves to provide rigidity to the package. Materials that are suitable for forming layers 16 and 18 include polyvinyl chlorides, polystyrenes, polycarbonates, cellulosics, e.g. cellulose acetate, cellulose propionate, cellulose butyrate. The aforementioned materials are thermoformable. Materials that are not thermoformable, e.g. ionomers, e.g. polyethylene ionomer, can also be used. The thickness of layers 16 and 18 can vary, with typical thicknesses ranging from about two mils to about ten mils. Layers 16 and 18 must be transparent to whatever type of radiation is to be used to image the arrangement formed by the layers 20 and 22 of randomly disposed filaments 23.

Each web of the preferred embodiment further comprises an inner sealable layer 24 and 26. Materials that are suitable for forming layers 24 and 26 include heat sealable materials such as low density polyethylene, ethylene ionomers, and ethylene vinyl acetate. Materials that are not sealable by heat can also be used. However, an appropriate adhesive, preferably one that laminates to form a bond that does not peel, must then be used to seal the inner sealable layers to form the package. The thickness of layers 24 and 26 can vary, with typical thicknesses ranging from about two mils to about ten mils. Layers 24 and 26 preferably have the same transparency specifications as layers 16 and 18. However, the only visual requirements of layers 24 and 26 are that they provide sufficient contrast with the randomly disposed filaments 23 of intermediate layers 20 and 22 so that the image formed by the filaments can be discerned. It is preferred to seal layers 24 and 26 by means of a margin, circumscribing the package, of sufficient width so that the possibility of reaching the enclosed contents by entering the package by separating the webs by peeling apart the seal formed by the inner sealable layers without defacing the margin is nullified. In other words, as the width of the margin increases, the probability of defacing the material of the margin by peeling apart the seal formed by the inner sealable layers also increases. Typical margin widths can range from about $\frac{3}{8}$ in. to about 1 in., preferably from about $\frac{5}{8}$ in. to about $\frac{3}{4}$ in.

Each web of the preferred embodiment further comprises an intermediate layer 20 and 22, between the inner layers 24 and 26 and outer layers 16 and 18, comprising continuous filaments 23. The filaments 23 are disposed in a random arrangement such that the pattern is essentially impossible to duplicate. This arrangement will serve as the unique "fingerprint" of the package. As used herein, the term "continuous" means not chopped. As used herein, the term "random" means having complete lack of design, intent, plan, or prearrangement. The random arrangement comes about because an extremely large number of filaments of very small diameter are oriented in an uncontrolled manner, resulting in extremely complicated shapes in a small area. The filaments 23 are preferably formed of non-woven, spunbonded fibers. It is also preferred that the filaments 23 be arranged in a discontinuous web, i.e. the web has open spaces in it. Filaments suitable for the present invention can be prepared in accordance with U.S. Pat. No. 3,575,782, incorporated herein by reference. Materials suitable for preparing the filaments include polyolefins, e.g. polypropylene, polyamides, e.g. nylon, polyesters, e.g. polyethylene terephthalate, and polyurethanes. The fibers preferably weigh from about 0.3 to about 1.2 oz./sq. yd. It is preferred that the filaments not be too heavy, because filaments of a heavier weight reduce optical transmission, with the result that the random arrangement formed by the filaments is difficult to discern. The type of material selected for the filaments 23 is determined in part by the method of manufacturing the webs and the method of sealing the two webs together to make the package. If a lamination process, wherein heat is employed, is used to manufacture the webs, in which the material of the inner sealable layer melts, flows, and fuses with the filaments, the filaments must have a melting temperature higher than that of the material of the inner sealable layer. This melting point requirement also holds if the inner layers 24 and 26 are to be bonded together to form the package by means of a heat sealing process. The filaments 23 must be of a color and optical density so that the package will be amenable to being imaged by the method of imaging desired by the user. It is preferred that the filaments 23 allow at least 70% optical transmission, i.e. at least 70% of the radiation incident to the layer of filaments must be capable of passing through that layer. It is also preferred that the filaments be gray or purple in color, in order to insure both easy in viewing and ease of examination of the arrangement formed by the filaments.

Commercially available materials for the filaments 23 that are suitable for this invention include spun-bonded polyethylene terephthalate ("Reemay" 2006 and "Reemay" 2014, available from E. I. duPont de Nemours & Co., "Lutradur" VP 229 and "Lutradur" VP 230, available from The Lutravil Company), spun-bonded (nonwoven) nylon ("Cerex", available from Monsanto Company). Because these fibers have melting temperatures in the range of 210° C. to 290° C., they can be used at laminating temperatures that would melt polypropylene, rayon, or polyurethane. If a different method were used to prepare the webs, i.e. one in which a temperature lower than 210° C. were employed, the following commercially available materials for the filaments 23 could be used to form the filamentous layers of the webs: polypropylene ("Celestra", available from Crown Zellerbach Corp.), rayon, polyurethane ("Q-Thane" PE 90 and "Q-Thane" PE 100, available from K. J. Quinn & Co., Inc.), rayon/acetate (available from Minnesota Mining and Manufacturing Company).

It is preferred that at least one of the webs be formed (i.e. molded), preferably by means of thermal energy, so as to create a compartment for securely holding documents or other articles.

Figure 4:
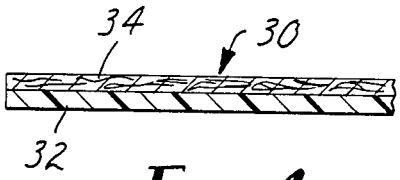
FIG. 4 is a sectional view of a web of a second embodiment of this invention.

In a second embodiment of this invention, as shown in FIG. 4, the web 30 need only consist of two layers, a support layer 32 formed of a sealable polymeric material, and a filamentous layer 34 bonded to or embedded in the support layer. So long as delamination of the web will result in alteration of the random pattern of the filaments, the two-layer embodiment will be satisfactory for the tamper-indicating purpose previously described.

Figure 5:
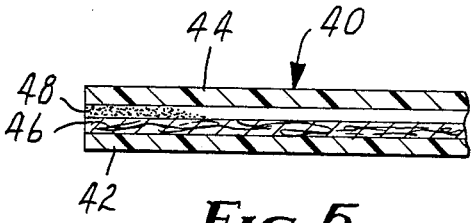
FIG. 5 is a sectional view of a web of a third embodiment of this invention.

In a third embodiment of this invention, as shown in FIG. 5, the web 40 of the three-layer preferred embodiment comprising inner layer 42, outer layer 44, and intermediate layer 46 is modified by introducing a fourth layer 48 of adhesion promoting material between the filamentous layer and the outer polymeric layer. The adhesion promoting material is preferably used when the inner sealable layer 42 and the outer polymeric layer 44 will not bond except at extremely high temperatures.

Figure 6:
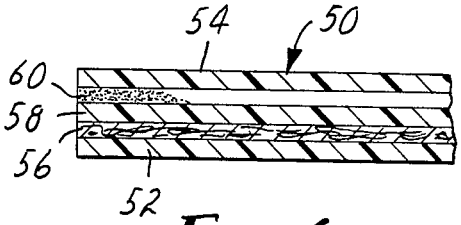
FIG. 6 is a sectional view of a web of a fourth embodiment of this invention.

In a fourth embodiment of this invention, as shown in FIG. 6, the web 50 of the three-layer preferred embodiment comprising inner layer 52, outer layer 54, and intermediate layer 56 is modified by introducing two additional layers 58 and 60 between the filamentous layer 56 and the outer polymeric layer 54. Overlying the filamentous layer is a layer of sealable material 58. Intermediate between the layer of sealable material 58 and the outer polymeric layer 54 is a layer 60 of adhesion promoting material.

Webs can be made by means of commercially available laminating apparatus, an example of which is the Rexam Laminex Laminator Model PAK IX, a laboratory unit. Liners bearing a release coating on both major surfaces thereof can be used to aid in transporting the laminate through the laminating apparatus. Alternatively, hot rolls coated with a release coating, e.g. polytetrafluoroethylene, can be used. Preparation of the three layered preferred embodiment, which is illustrated in FIGS. 1, 2, and 3, can be carried out by a simple laminating process. First, a sheet of sealable material is placed on the surface of the liner. Then, a layer of filaments is placed over the sheet of sealable material. Finally, it is preferred that a second silicone release liner be placed over the layer of filaments. The assembly is then laminated under conditions of temperature and pressure for sufficient duration to fuse the sealable material to the filaments.

The second release liner is removed from the laminate. Then a sheet of polymeric material, i.e. the outer layer, is placed over the surface of the inner layer upon which the filaments were originally placed. The release liner is then placed over the sheet of polymeric material, and the assembly is then laminated under conditions of temperature and pressure for sufficient duration to fuse the sheet of polymeric material, i.e. the outer layer, to the inner layer. The intermediate layer comprised of discrete filaments will be located between the inner layer and the outer layer. If the material of the outer layer will not readily adhere to the material of the inner layer upon lamination, an adhesion promoting layer can be pre-laminated to the outer layer prior to laminating the outer layer to the inner layer. The adhesion promoting layer will, of course, help the outer layer adhere to the inner layer. An adhesion promoting layer is shown in FIGS. 5 and 6.

The following table sets forth various materials and the properties thereof and laminating conditions that can be used for making the webs for the packages of this invention:

TABLE I

| Laminating temperature (°C.) | Outer layer | Inner layer | Filament layer | Adhesion promoting layer |
|---|---|---|---|---|
| 200 | Polyvinyl chloride | Ethylene vinyl acetate (27–28% vinyl acetate) | Polyethylene terephthalate | Ethylene vinyl acetate (27–28% vinyl acetate) |
| 200 | Polystyrene | Ethylene vinyl acetate (27–28% vinyl acetate) | Polyethylene terephthalate | Ethylene vinyl acetate (27–28% vinyl acetate) |
| 200 | Polypropylene | Ethylene vinyl acetate (27–28% vinyl acetate) | Polyethylene terephthalate | Ethylene vinyl acetate (27–28% vinyl acetate) |
| 200 | Poly- | Ethylene | Poly- | Ethylene |

TABLE I-continued

| Laminating temperature (°C.) | Outer layer | Inner layer | Filament layer | Adhesion promoting layer |
|---|---|---|---|---|
| | carbonate | vinyl acetate (27–28% vinyl acetate) | ethylene terephthalate | vinyl acetate (27–28% vinyl acetate) |
| 200 | Polyvinyl chloride | Ionomer ("Surlyn") | Polyethylene terephthalate | Ethylene vinyl acetate (27–28% vinyl acetate) |

OPERATION

The webs used to illustrate the operation of the package of this invention comprise an outer layer made of "Surlyn" resin (an ionomer resin, i.e. a matrix of hydrocarbons in which are embedded relatively short polyethylene chains and granules of polymethacrylate linked with sodium ions, available from E. I. duPont de Nemours & Co.) and inner layer made of "Surlyn" resin, and filaments made of polyester.

The contents 28, for example, punch cards, are placed in the recess formed in web 12. Web 14 is placed in register with web 12, and the two webs are fused by means of sealing the inner layers together preferably by means of heat. Heat sealers that are useful for preparing the packages of this invention include impulse heat sealers and hot bar heat sealers. Typical operating conditions for hot bar heat sealers are 300° F.–400° F. for a period of 5 to 10 seconds at a pressure of 90 psig. A commercially available sealer suitable for preparing the package of this invention is the "Sentinal" heat sealer. The margin is very wide, for example, about ⅜ in. to about 1 in., while the length of the edges of the package is very small, for example, about 0.012 in. to about 0.018 in. As used herein, the term "length of the edge" means the shortest distance extending from the outer layer 16 of web 12 to the outer layer 18 of web 14, as measured through a point on the surface of the margin nearest the edge. In other words, the length of the edge of a given package is the sum of the thicknesses of each layer comprising the package. If one were to thrust a sharp object into the edge of the package in an effort to peel apart the two webs 12 and 14 to gain access to the contents thereof, he would almost certainly deface the package in the area of the margin before he could contact the documents. For example, it would be virtually impossible to thrust a sharp object into the edge formed by layers 16, 18, 20, 22, 24, 26 while keeping the sharp object essentially parallel to layers 16, 18, 20, 22, 24, 26 so as not to deface the margin. By departing from the parallel direction by only an extremely small angle, the sharp object would puncture the margin, and this puncture would be visible to the unaided eye. Moreover, more than negligible tampering with the package would very likely alter the "fingerprint" formed by the randomly disposed filaments.

Prior to sending the sealed package, the sender would prepare an image of each of the webs of the package. Imaging can be conducted by photographic means, photocopying means, laser scanning means, optical scanning means, infrared photographic means, ultraviolet scanning means, by densitometer, etc. The print of the image can be sent via electronic transmission or mail to the receiving location. In order to determine whether the package has been tampered with, the recipient can compare the images prepared by the sender with the arrangements formed by the randomly disposed filaments of the intermediate layer of the web. If the images and the arrangements do not match, the sender and receiver will be aware of tampering by means of package destruction and replacement thereof and can void the contents compromised. Furthermore, if the margin showed any signs of being defaced, the receiver will be aware of tampering and subsequent resealing of the original package.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. A tamper-indicating package comprising first and second generally coextensive webs marginally joined together to define said package, each of said webs comprising a layer of sealable material, a layer of filaments disposed in a random arrangement bonded to said layer of sealable material, said webs being joined together by means of a seal so as to form a margin circumscribing the package, said margin being of sufficient width so that access to the interior of said package can be effected only upon destruction of the sealable material or upon altering the random arrangement in which the filaments are disposed.

2. A package according to claim 1 wherein said layer of sealable material is made of heat sealable material.

3. A package according to claim 1 wherein said layer of sealable material comprises a polymer selected from the group consisting of polyethylene, ethylene vinyl acetate, and ionomer resin.

4. A package according to claim 1 wherein said layer of filaments comprises material selected from the group consisting of polyolefins, polyamides, polyesters, and polyurethanes.

5. A tamper-indicating package comprising first and second generally coextensive webs marginally joined together to define said package, each of said webs being a laminate comprising an inner layer of sealable material, an outer layer of polymeric material, an intermediate layer between said inner layer and said outer layer comprising randomly disposed filaments, said webs being joined together by means of a seal so as to form a margin cicumscribing the package, said margin being of sufficient width so that access to the interior of said package can be effected only upon destruction of the sealable material or upon altering the arrangement in which the filaments are disposed.

6. A package according to claim 5 wherein said outer layer is made of thermoformable material.

7. A package according to claim 5 wherein said outer layer comprises polyvinyl chloride.

8. A package according to claim 5 wherein said inner layer is made of a heat sealable material.

9. A package according to claim 5 wherein said inner layer comprises a polymer selected from the group consisting of polyethylene, ethylene vinyl acetate, and ionomer resin.

10. A package according to claim 5 wherein said intermediate layer comprises filaments of material selected from the group consisting of polyolefins, polyamides, polyesters, polyurethanes.

11. A package according to claim 5 wherein said randomly disposed filaments form an arrangement that will be altered when the marginal seal joining the webs of the package is the subject of tampering.

12. The package of claim 5 further including a fourth layer between said intermediate layer and said outer layer, said fourth layer being made of a heat sealable material and being sealed to said outer layer by heat.

13. The package of claim 12 further including a fifth layer between said fourth layer and said outer layer, said fourth layer being made of a material that adheres to both said fourth layer and said outer layer.

* * * * *